United States Patent [19]

Spotz

[11] 3,982,965

[45] Sept. 28, 1976

[54] WATER JET CLEANING APPLIANCE

[76] Inventor: Donald R. Spotz, 6261 SW. 5th Court, Plantation, Fla. 33317

[22] Filed: Mar. 10, 1975

[21] Appl. No.: 556,946

[52] U.S. Cl. ..... 134/100; 134/175; 134/200; 4/165

[51] Int. Cl.[2] ..... B08B 3/02

[58] Field of Search ..... 4/1, 165; 128/66, 370; 134/44, 99–102, 175, 177, 198–200

[56] References Cited

UNITED STATES PATENTS

| | | | |
|---|---|---|---|
| 2,025,936 | 12/1935 | Clearman | 134/102 X |
| 2,394,760 | 2/1946 | Felton | 134/102 X |
| 2,537,119 | 1/1951 | Bauerlein et al. | 222/133 X |
| 3,092,120 | 6/1963 | Hilger et al. | 134/100 X |
| 3,207,384 | 9/1965 | Wall | 222/145 X |
| 3,885,709 | 5/1975 | Levy | 222/133 |

*Primary Examiner*—Robert L. Bleutge
*Attorney, Agent, or Firm*—Oltman and Flynn

[57] ABSTRACT

The present cleaning appliance has a cleaning chamber for receiving the finger to be cleaned, a jet nozzle at the upper end of this chamber for discharging pressurized water onto the finger, a reservoir for a cleaning solution directly above the cleaning chamber, and a manually operated plunger and a check valve controlling the flow of the cleaning solution from the reservoir down into the cleaning chamber. The cleaning solution is conducted separately down to the jet nozzle where it becomes entrained with the water after the latter has just emerged from the jet nozzle.

15 Claims, 5 Drawing Figures

WATER JET CLEANING APPLIANCE

CROSS REFERENCE TO RELATED APPLICATION

The present invention is a variation or improvement in the apparatus disclosed in my co-pending U.S. patent application Ser. No. 520,562, filed Nov. 4, 1974, now Pat. No. 3,943,951.

BACKGROUND OF THE INVENTION

Various occupations, such as that of automotive mechanics, involve getting the fingers dirty or greasy and often it is rather difficult for such workers to clean their fingers thoroughly, particularly under the finger nails, at the completion of the work day. The same problem exists in households and various occupations such as among hospital and restaurant personnel and in various manufacturing occupations where an exceptionally high degree of personal cleanliness must be maintained. Harsh or abrasive soaps or cleaning compounds are not an entirely adequate answer to this problem, both from the standpoint of effective and thorough cleaning of the hands and from the standpoint of their harmful effects on the skin of some persons.

Varous special purpose cleaning appliances have been proposed heretofore, such as the forearm and hand cleaning devices shown in U.S. Pat. No. 3,757,806 to Bhaskar et al. and U.S. Pat. No. 3,699,984 to Davis, and the hand cleaning devices shown in U.S. Pat. No. 3,205,620 to Woodworth et al. and U.S. Pat. No. 3,220,424 to Nelson.

SUMMARY OF THE INVENTION

The present invention is directed to a novel and improved cleaning appliance whose principal utility is believed to be in cleaning the ends of the fingers, particularly under and around the finger nails. In the preferred embodiment, only one finger at a time is inserted into the appliance for cleaning. A high pressure water jet, preferably pulsating, is discharged onto the end of the finger being cleaned. A soap or other liquid cleaning solution is conducted separately to where the water jet has just emerged from the jet nozzle, and here it becomes entrained with the jet so as to be sprayed onto the finger. The present invention embodies a manually-operated plunger and a check valve for controlling the separate flow of this soap solution into the water jet. Preferably, the water supply for the present appliance comes from a known type of high pressure, pulsating, water cleaning apparatus now in common use for oral hygiene.

A principal object of this invention is to provide a novel and improved water-operated appliance that is particularly adapted for cleaning the extremities of the hands or feet, particularly the finger nails.

Another object of this invention is to provide such an appliance having a novel and advantageous arrangement for controlling the addition of soap or other cleaning solution to a water jet that is sprayed onto the finger.

Further objects and advantages of this invention will be apparent from the following detailed description of a presently preferred embodiment shown in the accompanying drawing in which.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figure 1:
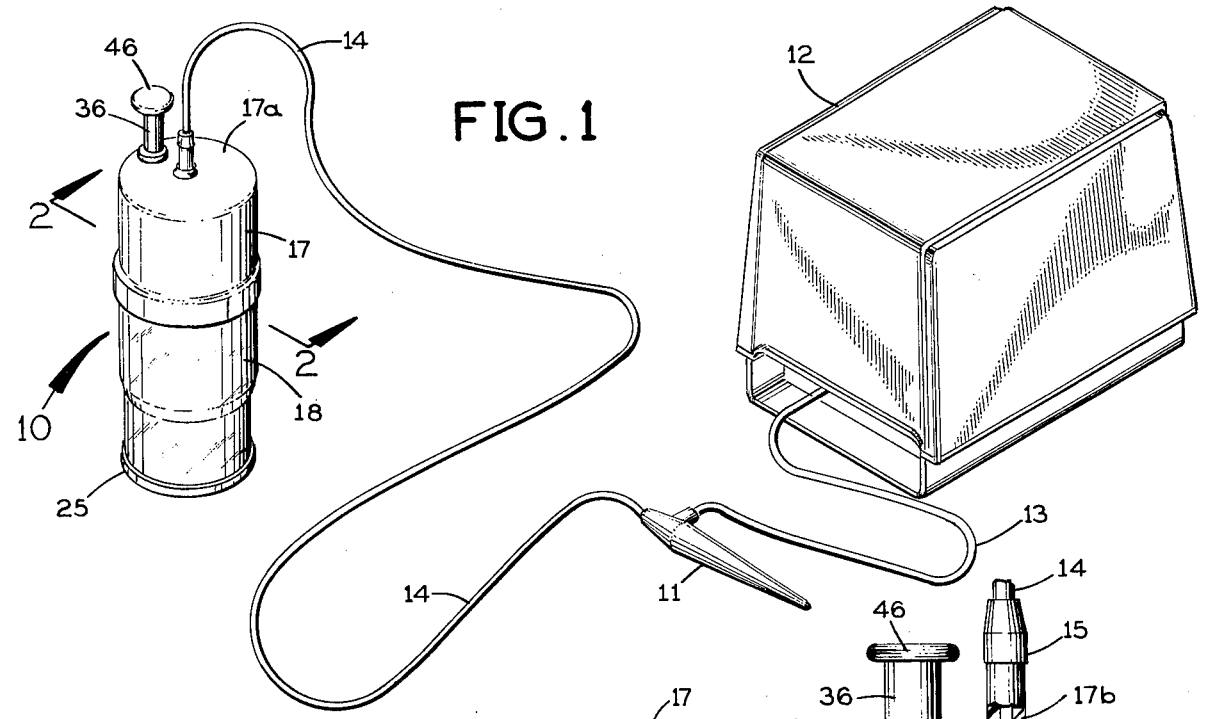
FIG. 1 is a schematic perspective view showing the present cleaning appliance connected to a known type of pulsating, high pressure, oral hygienic implement.

Referring first to Figure 1, the appliance of the present invention is designated in its entirety by the reference numeral 10 and it is shown connected to the coupling 11 of a known type of implement which uses high pressure pulsations of water to clean the teeth and gums. This implement, sometimes known as a "Water Pik", includes a housing 12 containing a pump (not shown) whose inlet may be connected to a supply of water. This pump produces a pulsating flow of water at high pressure in a flexible conduit 13 leading to the coupling 11. As known, a jet nozzle device may be attached to this coupling for discharging pulsating jets of water that may be used for oral hygiene. As an illustrative example, the implement 11–13 may be generally of the type disclosed in U.S. Pat. No. 3,277,158.

In the preferred embodiment, the present appliance is provided with a flexible inlet hose 14 that is detachably connected at one end in any suitable manner to the coupling 11 to receive from it the high pressure pulsations of water. The opposite end of inlet hose 14 is connected by a suitable coupling 15 to the upper end of the appliance 10.

Figure 2:
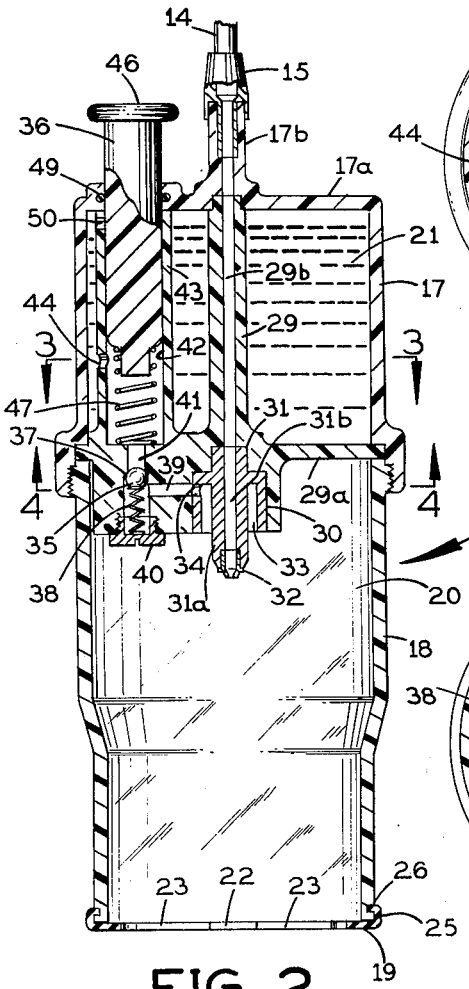
FIG. 2 is a vertical longitudinal section of the present cleaning appliance before use.
Figure 3:
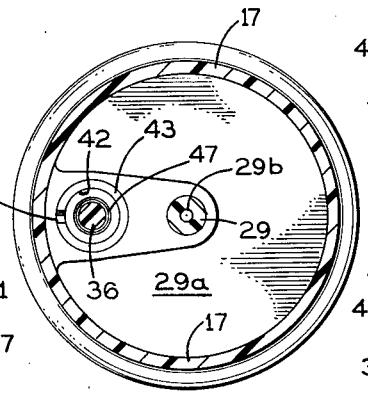
FIG. 3 is a horizontal cross-section taken along the line 3—3 in FIG. 2.
Figure 4:
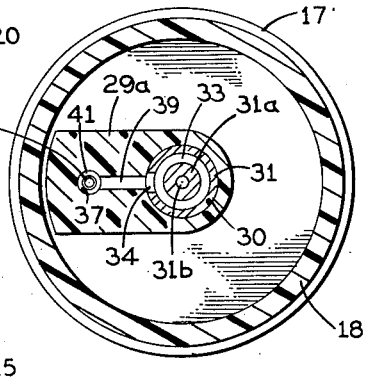
FIG. 4 is a horizontal cross-section taken along the line 4—4 in FIG. 2.

Referring now to FIG. 2, the present appliance comprises a receptacle having a rigid, inverted, cup-shaped top 17 which has its lower end screw-threadedly attached to the upper end of a generally cylindrical lower body 18. The receptacle top 17 presents a flat, horizontal upper end wall 17*a*. A generally cup-shaped diaphragm 19 of suitable elastomeric material is mounted on the bottom of the lower body 18 and extends across the latter's lower end. This diaphragm presents a circular central opening 22 (FIG. 2) and plurality of sectors 23 in succession circumferentially around this opening. These sectors 23 are separated by radial slits formed in the elastomeric material of the diaphragm and extending outward from the central opening 22.

Figure 5:
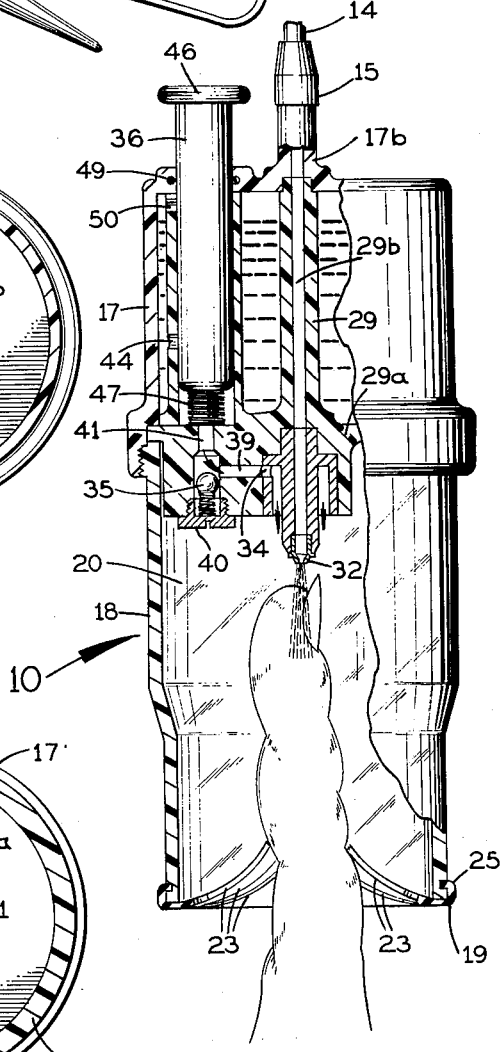
FIG. 5 is a view generally similar to FIG. 2 and showing the appliance in use.

With this construction, as shown in FIG. 5, the sectors 23 of the diaphragm are flexible individually to permit the entry of a finger of an adult human hand inserted through the central opening 22. With the finger inserted, the sectored diaphragm closes the lower end of the lower body 18 almost completely, so that only a relatively small smount of liquid leakage can occur, at most.

The diaphragm 19 has an annular, upstanding, peripheral flange 25 with an inturned lip 26 at its upper end that fits snugly on the lower body 18.

A centrally positioned, vertically disposed tube 29 extends down from the upper end wall 17*a* of the receptacle top 17 and carries a horizontal wall 29*a* at its lower end, whose periphery is engaged between the adjoining ends of the top 17 and the lower body 18 of the receptacle. This wall 29*a* constitutes both the upper end wall of a cleaning chamber 20 inside the lower body 18 of the receptacle and the bottom wall of a reservoir 21 inside the inverted cup-shaped top 17 of the receptacle. The receptacle top 17 presents a horizontally disposed top wall 17*a* which is shaped above the dividing wall 29*a*.

The upper end of the reservois 21 may have a vent (not shown) to the atmosphere, if desired.

The receptacle 17 has a vertically disposed, centrally positioned, tubular nipple 17*b* projecting up from its upper end wall 17*a*, and the inlet hose 14 is attached to this nipple by coupling 15 in liquid-tight fashion. The tub 29 inside the reservoir 21 has a central vertical passageway 29*b* which provides a continuation of the central passageway through the nipple 17*b* for passing water coming in through the inlet hose 14.

At the left side in FIG. 2, the dividing wall 29*a* of the receptacle is substantially thicker vertically and it presents a counterbored central recess 30, which is coaxial with the passageway 29*b* down through tube 29. A nozzle member 31 is tightly received in this recess 30 and presents a downwardly projecting, central tube 31*a* having a central passageway 31*b* which is a continuation of the passage 29*b*. This nozzle member carries a jetforming insert 32 at the lower end of its passage 31*a*. The nozzle member 31 also presents an annular recess 33 which extends around the outside of the downwardly projecting, central tube 31*a* and is open at the bottom. At its left side in FIG. 2, the nozzle member has an inlet port 34 which leads into the upper end of the annular, downwardly-facing recess 33.

In accordance with the present invention, liquid cleaning solution is supplied from the reservoir 21 to the annular recess 33 in the nozzle under the control of a dispenser which includes a check 35 and a plunger 36. This dispenser discharges a predetermined amount of the cleaning solution each time the plunger 36 is operated, as described hereinafter.

As shown in FIG. 2, the check valve 35 comprises a ball which is normally seated against a downwardly-facing, annular valve seat 37 by a compression spring 38. Below this seat, a horizontal passage 39 leads over to the nozzle inlet port 34. The lower end of spring 38 is engaged by a screw-threaded plug 40, which is threadedly received in the bottom of the divider wall 29*a* and is adjustable to vary the bias force exerted by the spring.

The divider wall 29*a* presents a vertical passage 41 leading down to the valve seat 37 from a cylindrical chamber 42 above. This chamber is formed in an upwardly extending cylinder 43 which, as shown, may be formed integral with the divider wall 29*a*. The cylinder 43 has an inlet port 44 which provides fluid communication between the reservoir 21 and the cylinder chamber 42.

The plunger 36 is slidably reciprocable in the cylinder 43, and on its upper end it presents a transverse enlargement 46 disposed above the upper end wall 17*a* of the receptacle top for engagement there by the user's finger. A compression spring 47 acts between the plunger 36 and the bottom of the cylinder chamber 42 to bias the plunger upward to the position shown in FIG. 2, in which the inlet port 44 is uncovered, so that the reservoir 21 and the cylinder chamber 42 are in fluid communication with one another.

The wall 17*a* carries an O-ring 49 of rubber-like material which is in sealing engagement with the inside of the cylinder 43 above the inlet port 44 in all positions of the plunger.

Normally, the parts of the dispenser are positioned as shown in FIG. 2, with the check valve 35 closed and the plunger 36 retracted upward by its spring 47. In this position of the parts, the cylinder chamber 42 below the plunger receives liquid cleaning solution from the reservoir 21.

When the plunger 36 is depressed manually, it exerts increasing pressure on the cleaning solution below to unseat the check valve 35, so that the cleaning solution now flows through passage 39 and port 34 into the downwardly-open recess 33 in nozzle member 31, as shown in FIG. 5. This liquid now flows down along the outside of the central tube 31*a* on the nozzle member.

If, at this time, the pump in the cleaning implement 12 is on, high pressure pulsations of water are delivered through conduits 13 and 14 to the inlet fitting 17*b* of the present cleaning device. The water flows down through the passageway 29*b* leading to the jet-forming device 32 on the lower end of the nozzle member 31, where it is discharged in the form of pulsating jets that spray against the finger nail as shown in FIG. 5. The liquid soap or other cleaning solution that flows down around the outside of the central tube 31*a* in the nozzle member 31 becomes entrained with the high velocity water jet coming out of the nozzle.

The pump in the cleaning implement 12 may be left on after the dispenser is off, so that the finger nail may be rinsed with clear water. The appliance may be made entirely of clear plastic parts so that the cleaning results may be observed.

If desired, the present cleaning appliance may be modified structurally to enable its use for cleaning the toe nails.

Also, if desired, this appliance may be connected directly to a water faucet which would serve directly as the source of pressurized water. A hydraulic pulsating amplifier may be included in the water connection if desired.

When the reservoir 21 is to be filled with liquid cleaning solution, the plunger 36 is removed completely and the solution is poured down into the cylinder 43, flowing out of the cylinder via the opening 44 into the reservoir proper. At this time, the upper end of the reservoir 21 is vented to the atmosphere through the upper cylinder opening 50 and the now-open upper end of the cylinder.

I claim:

1. In a personal cleaning appliance for using pressurized water to clean the extremities of a person's hand or foot, said appliance having:

a receptacle defining a cleaning chamber for receiving the extremity to be cleaned;

means on said receptacle at one end of said cleaning chamber for the insertion of the extremity to be cleaned;

jet nozzle means for discharging pressurized water into said cleaning chamber; and means for connection to a water source having a water passage therethrough leading to said jet nozzle means for passing pressurized water thereto;

the improvement which comprises:

means for selectively dispensing a predetermined quantity of liquid cleaning solution into the pressurized water discharge from said jet nozzle means;

said dispensing means comprising a reservoir in said receptacle for the cleaning solution;

a normally-closed spring-biased check valve connected between said reservoir and said jet nozzle means to control the flow of the cleaning solution from said reservoir into the pressurized water discharge from said jet nozzle means; and a manually operable plunger for effecting the opening of the check valve to enable the cleaning solution flow into the pressurized water discharge from said jet nozzle means.

2. A cleaning appliance according to claim 1, and further comprising:

means defining a cylinder in which said plunger is reciprocable, said cylinder having an inlet port communicating with said reservoir;

and wherein:

said plunger has a predetermined stroke in said cylinder, between a retracted position away from said check valve and unblocking said inlet opening and a position toward said check valve blocking said opening, for pressurizing the liquid solution in the cylinder between the plunger and the check valve to force open the check valve.

3. In a personal cleaning appliance for using pressurized water to clean the extremities of a person's hand or foot, said appliance having:

a receptacle defining a cleaning chamber for receiving the extremity to be cleaned;

means on said receptacle at one end of said cleaning chamber for the insertion of the extremity to be cleaned;

jet nozzle means for discharging pressurized water into said chamber;

means for connection to a water source having a water passage therethrough leading to said jet nozzle means for passing pressurized water thereto;

a reservoir in said receptacle for holding liquid cleaning solution; and passage means extending from said reservoir to said jet nozzle means;

the improvement which comprises:

a normally-closed, spring-biased check valve in said passage means for normally blocking the flow of cleaning solution from said reservoir to said jet nozzle means; and manually operable means for selectively forcing said check valve open against its spring bias to pass cleaning solution from said reservoir into the pressurized water discharge from said jet nozzle means.

4. A cleaning appliance according to claim 3, wherein said manually operable means is a plunger reciprocable toward and away from said check valve, and further comprising:

means in said receptacle defining a cylinder slidably receiving said plunger, said cylinder having an inlet opening in fluid communication with said reservoir for passing the liquid cleaning solution into the cylinder between the plunger and the check valve when the plunger is retracted away from the check valve;

said plunger when forced manually toward said check valve blocking said inlet opening and pressurizing the cleaning solution between the plunger and the check valve to force open the check valve.

5. A cleaning appliance according to claim 4, and further comprising spring means biasing said plunger to a retracted position away from said check valve and unblocking said inlet opening.

6. A cleaning appliance according to claim 4, wherein:

said reservoir for the liquid cleaning solution is disposed above said jet nozzle means;

said cylinder for the plunger extends up into said reservoir;

said inlet opening into the cylinder is spaced above said check valve; and said plunger is slidable in said cylinder down toward said check valve to block said inlet opening into the cylinder and force open the check valve.

7. A cleaning appliance according to claim 6, wherein said plunger extends up beyond said receptacle for manual actuation at its upper end.

8. A cleaning appliance according to claim 7, and further comprising spring means biasing said plunger upward away from said check valve to a position unblocking said inlet opening into the cylinder.

9. A cleaning appliance according to claim 3, wherein said passage means extends from said check valve to the outside of said jet nozzle means for passing liquid cleaning solution thereto separately from said water passage to become entrained in the pressurized water jet issuing from said jet nozzle means.

10. A cleaning appliance according to claim 9, wherein:

said reservoir for the liquid cleaning solution is disposed above said jet nozzle means;

said receptacle has means defining a cylinder which extends up into said reservoir;

said manually operable means is a plunger slidably received in said cylinder for movement down toward said check valve and up away from said check valve; and said cylinder has an inlet opening spaced above said check valve for passing liquid cleaning solution from the reservoir down into the cylinder below the plunger when the latter is retracted up away from the check valve;

said plunger when forced down toward said check valve blocking said inlet opening into the cylinder and pressurizing the cleaning solution below the plunger to force open the check valve.

11. A cleaning appliance according to claim 10, wherein said plunger extends up above said receptacle for manual actuation thereat, and further comprising spring means biasing the plunger to a retracted position up away from the check valve and unblocking said inlet opening.

12. A cleaning appliance according to claim 3, wherein said jet nozzle means has a central, downwardly extending tube with a water passage therein for discharging water at the bottom, and an annular recess around the outside of said central tube which is connected to said passage means and is open at the bottom for passing the liquid solution down around the outside of said central tube to become entrained in the pressurized water jet discharged at the bottom of said tube.

13. A cleaning appliance according to claim 12, wherein said reservoir for the liquid cleaning solution is disposed above said jet nozzle means;

said receptacle has means defining a cylinder which extends up into said reservoir;

said manually operable means is a plunger slidably received in said cylinder for movement down toward said check valve and up away from said check valve; and said cylinder has an inlet opening spaced above said check valve for passing liquid cleaning solution from the reservoir down into the cylinder below the plunger when the latter is retracted up away from the check valve;

said plunger when forced down toward said check valve blocking said inlet opening into the cylinder and pressurizing the cleaning solution below the plunger to force open the check valve.

14. A cleaning appliance according to claim 13, wherein said plunger extends up beyond said receptacle for manual actuation at its upper end.

15. A cleaning appliance according to claim 14, and further comprising spring means biasing said plunger upward away from said check valve to a position unblocking said inlet opening into the cylinder.

* * * * *